US007775717B2

(12) United States Patent
DeLuca

(10) Patent No.: US 7,775,717 B2
(45) Date of Patent: Aug. 17, 2010

(54) COMPACTED BAG CONFIGURATION AND METHOD FOR MAKING THE SAME

(75) Inventor: Nicholas P. DeLuca, Washington, DC (US)

(73) Assignee: Sealed Air Corporation (US), Saddle Brook, NJ (US)

( * ) Notice: Subject to any disclaimer, the term of this patent is extended or adjusted under 35 U.S.C. 154(b) by 1283 days.

(21) Appl. No.: 11/249,108

(22) Filed: Oct. 12, 2005

(65) Prior Publication Data

US 2007/0080092 A1 Apr. 12, 2007

(51) Int. Cl.
*B65D 1/34* (2006.01)
*B65D 69/00* (2006.01)

(52) U.S. Cl. ..... 383/120; 206/494; 206/389; 206/554

(58) Field of Classification Search ..... 206/494, 206/233, 389, 390, 391, 395, 554; 493/243, 493/244, 250, 261; 383/120, 37, 207, 208, 383/209, 109, 111
See application file for complete search history.

(56) References Cited

U.S. PATENT DOCUMENTS 1,910,313 A * 5/1933 Altman ..... 383/207
2,307,902 A * 1/1943 Vogt et al. ..... 383/106
2,607,078 A 8/1952 Grimes
2,819,834 A 1/1958 Brady
2,995,990 A 8/1961 Pierce et al.
3,071,308 A * 1/1963 Lange ..... 229/110
3,347,137 A 10/1967 Barraclough
3,348,458 A 10/1967 Tipper
3,349,991 A 10/1967 Kessler
3,426,892 A 2/1969 Poncy
3,430,843 A * 3/1969 Fesco ..... 55/361
3,457,707 A * 7/1969 Fesco ..... 55/376

(Continued)

FOREIGN PATENT DOCUMENTS

DE 202 12 882 10/2002

(Continued)

OTHER PUBLICATIONS

Partial International Search Report for corresponding International Application No. PCT/US2006/039014 mailed Mar. 28, 2007.

(Continued)

*Primary Examiner*—J. Gregory Pickett
*Assistant Examiner*—King M Chu
(74) *Attorney, Agent, or Firm*—Alston & Bird LLP

(57) ABSTRACT

A compacted tube structure for forming bags. The structure includes a plurality of alternating inner and outer longitudinally extending folds that define a plurality of outwardly extending projections. The outwardly extending projections are stacked one upon another on a first side and a second side of the structure on opposite sides of the longitudinal axis. The structure may further include at least one S-fold extending across a width for shortening the length of the structure. Top and bottom projections on each side may include an edge tab. The top and bottom edge tabs may be sealed together to form an edge margin on each side for retaining the compacted configuration of the structure. The structure may also include a plurality of separation lines and sealed ends for defining one or more bags.

16 Claims, 8 Drawing Sheets

U.S. PATENT DOCUMENTS

| | | | | | |
|---|---|---|---|---|---|
| 3,481,461 | A | * | 12/1969 | Paxton | 206/225 |
| 3,599,388 | A | | 8/1971 | Feingold | |
| 3,670,954 | A | | 6/1972 | Leventhal | |
| 3,674,135 | A | | 7/1972 | Simon | |
| 3,784,087 | A | | 1/1974 | Styers | |
| 3,936,890 | A | | 2/1976 | Oberstein | |
| 4,181,552 | A | | 1/1980 | Rayburn et al. | |
| 4,419,087 | A | | 12/1983 | Herrington | |
| 4,553,668 | A | | 11/1985 | James et al. | |
| 4,630,311 | A | | 12/1986 | Bentson | |
| 4,637,812 | A | | 1/1987 | Ogawa | |
| 4,653,252 | A | | 3/1987 | Van de Haar et al. | |
| 4,753,647 | A | | 6/1988 | Curtis | |
| 4,795,417 | A | | 1/1989 | O'Connell | |
| 4,859,083 | A | | 8/1989 | Nocek et al. | |
| 4,911,560 | A | | 3/1990 | Hoover et al. | |
| 4,931,052 | A | | 6/1990 | Feldman | |
| 4,981,374 | A | * | 1/1991 | Rutter et al. | 383/37 |
| 5,141,505 | A | | 8/1992 | Barrett | |
| 5,205,808 | A | | 4/1993 | Gebhardt | |
| 5,219,424 | A | | 6/1993 | Simhaee | |
| 5,304,158 | A | | 4/1994 | Webb | |
| 5,346,301 | A | * | 9/1994 | Scarberry et al. | 383/5 |
| 5,468,206 | A | * | 11/1995 | Buchanan | 493/189 |
| 5,478,153 | A | * | 12/1995 | Feldkamper | 383/114 |
| 5,518,313 | A | | 5/1996 | McAdam | |
| 5,752,666 | A | * | 5/1998 | Simhaee | 242/160.4 |
| 5,882,118 | A | | 3/1999 | Daniels et al. | |
| 5,952,025 | A | * | 9/1999 | Yannuzzi, Jr. | 426/107 |
| 6,061,999 | A | | 5/2000 | Wingert | |
| 6,068,584 | A | | 5/2000 | Daniels et al. | |
| 6,077,551 | A | * | 6/2000 | Scrimager | 426/107 |
| RE36,876 | E | | 9/2000 | Daniels et al. | |
| 6,254,521 | B1 | | 7/2001 | Pansier et al. | |
| 6,263,814 | B1 | | 7/2001 | O'Connor | |
| 6,286,680 | B1 | | 9/2001 | Hofrichter | |
| 6,367,976 | B1 | * | 4/2002 | Bannister | 383/85 |
| 6,488,222 | B1 | | 12/2002 | West et al. | |
| 6,527,445 | B2 | | 3/2003 | LaFleur et al. | |
| 6,561,963 | B2 | | 5/2003 | Totani | |
| 2002/0004656 | A1 | | 1/2002 | Khan et al. | |

FOREIGN PATENT DOCUMENTS

| | | | |
|---|---|---|---|
| FR | 1 476 742 | | 4/1967 |
| FR | 1476742 | * | 4/1967 |
| FR | 2842508 | * | 1/2004 |

OTHER PUBLICATIONS

International Search Report for corresponding International Application No. PCT/US2006/039014 mailed Oct. 1, 2007.

Written Opinion of the International Searching Authority for corresponding International Application No. PCT/US2006/039014 received on Apr. 18, 2007.

* cited by examiner

COMPACTED BAG CONFIGURATION AND METHOD FOR MAKING THE SAME

BACKGROUND OF THE INVENTION

1) Field of the Invention

The present invention generally relates to folded or compacted bags.

2) Description of Related Art

Thin film plastic bags, such as trash bags or packaging bags, may be made, for example, by extruding a continuous tube of high or low density polyethylene on a blown film extruding line. The tube may be heat sealed at bag-length intervals to form a bottom closure for each bag, and perforated between bags to create a top opening when a bag is separated from the tube. Such bags may be dispensed: 1) as a roll of sequentially connected bags from which bags are drawn and torn off, 2) individually from a holding container, or 3) from a pile or stack of joined bags.

However, such bags may be too bulky for some applications. For example, it may be desirable to provide a compact bag attached to a disposable product such as a disposable diaper or feminine hygiene product, to allow for convenient access to a bag in which to dispose such products after use.

BRIEF SUMMARY OF THE INVENTION

The present invention may address one or more of the above problems. A tube may be sinusoidally creased or folded about its circumference along a plurality of longitudinally extending fold lines, and arranged into a generally flat star-shaped cross-sectional configuration. The tube may be further compacted lengthwise by forming one or more S-folds along the width of the tube.

For example in one embodiment, a compacted tube structure includes a plurality of alternating inner and outer longitudinally extending folds. Together the folds define a plurality of outwardly extending projections or points. At least three of the outwardly extending projections or points are stacked one upon another on a first side of the structure and at least two of the outwardly extending projections are stacked one upon another on a second side of the structure. The first and second sides are on opposite sides of a longitudinal axis. The structure may also have at least one pair of approximately 180 degree turns across the width of the structure, each pair forming an S-fold that compacts or shortens the length of the structure.

Each side of the structure may include a top projection and a bottom projection. Each of the top and bottom projections includes an edge tab. The top and bottom edge tabs may be sealed together to form an edge margin enclosing the intermediate projections and retaining the compressed or compacted cross-sectional configuration of the structure.

Each side of the folded tube may include a longitudinal separation line, such as a perforation line. Each of these lines may extend through the top and bottom edge tabs, and between the edge margin and the one or more intermediate projections, to define a detachable release portion. The generally flat star-shaped configuration may include a plurality of transverse separation lines extending transversely across the width.

Another aspect of the present invention is a mandrel for arranging the tube into the compacted configuration. The mandrel includes an outer surface that extends from a first end to a second end. The outer surface defines a diameter that decreases from the first end to the second end. The mandrel further includes more than one groove. Each groove extends from the first end to the second end and extends inwardly from the outer surface to a predetermined depth. The depth of each groove increases from the first end to the second end. The cross-sectional perimeter of the mandrel remains substantially equal from the first end to the second end.

A folded bag may be attached to an article for convenient access.

BRIEF DESCRIPTION OF THE SEVERAL VIEWS OF THE DRAWING(S)

Having thus described the present invention in general terms, reference will now be made to the accompanying drawings, which are not necessarily drawn to scale, and wherein:

Figures 1, 2:
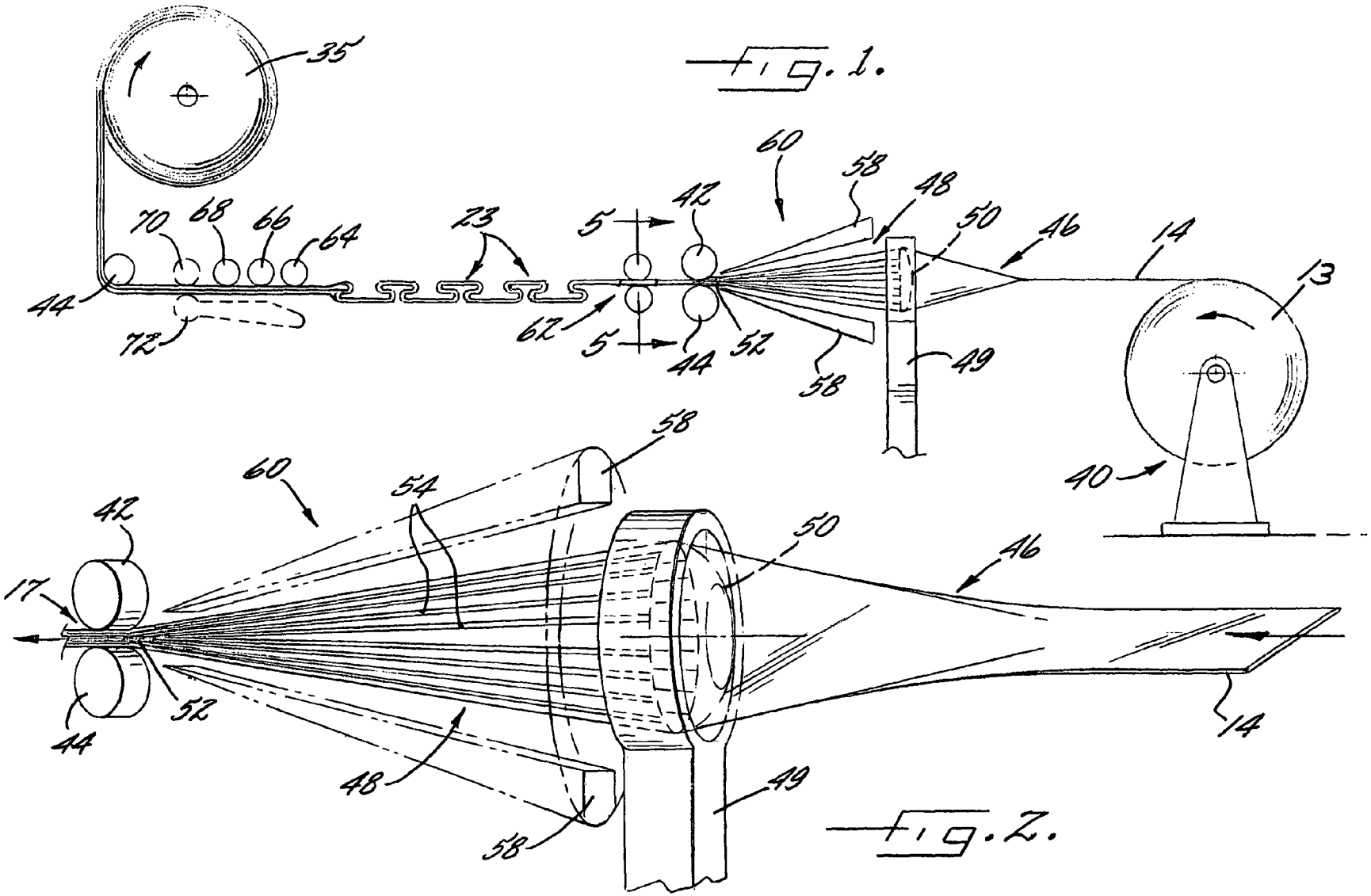
FIG. 1 is a diagrammatic side view of an apparatus and a method according to an embodiment of the present invention for constructing bags in a compacted configuration.
FIG. 2 is a perspective illustration of the creasing station shown in FIG. 1.
Figure 7:
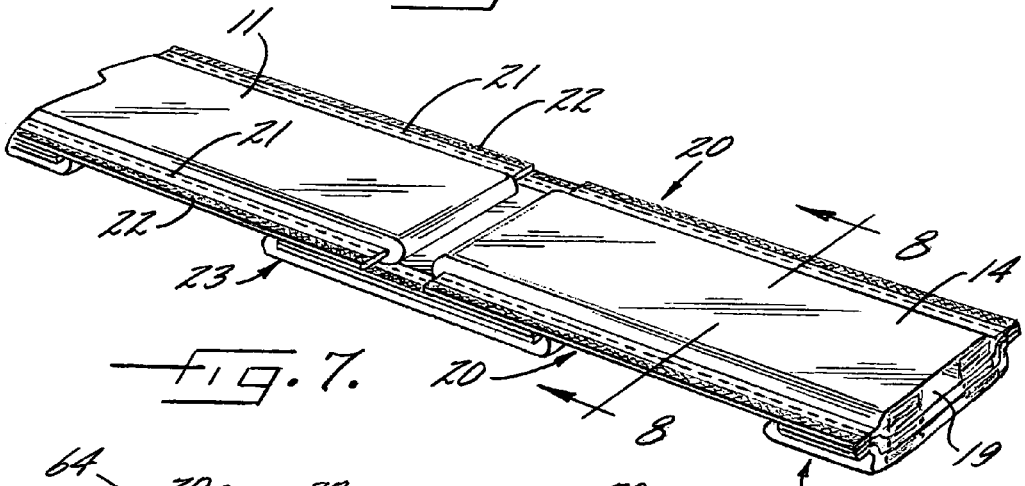
FIG. 7 is a perspective view of the S-folds in the tube 14.
Figure 8:
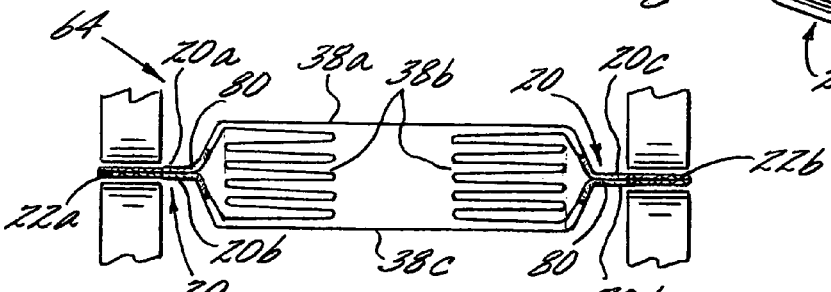
Figure 9:
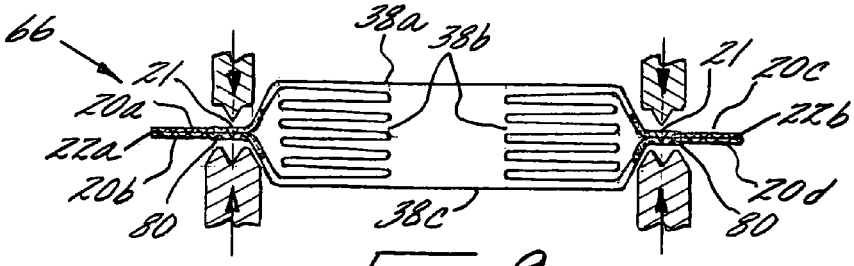
Figures 10, 11, 12, 13A, 13B:
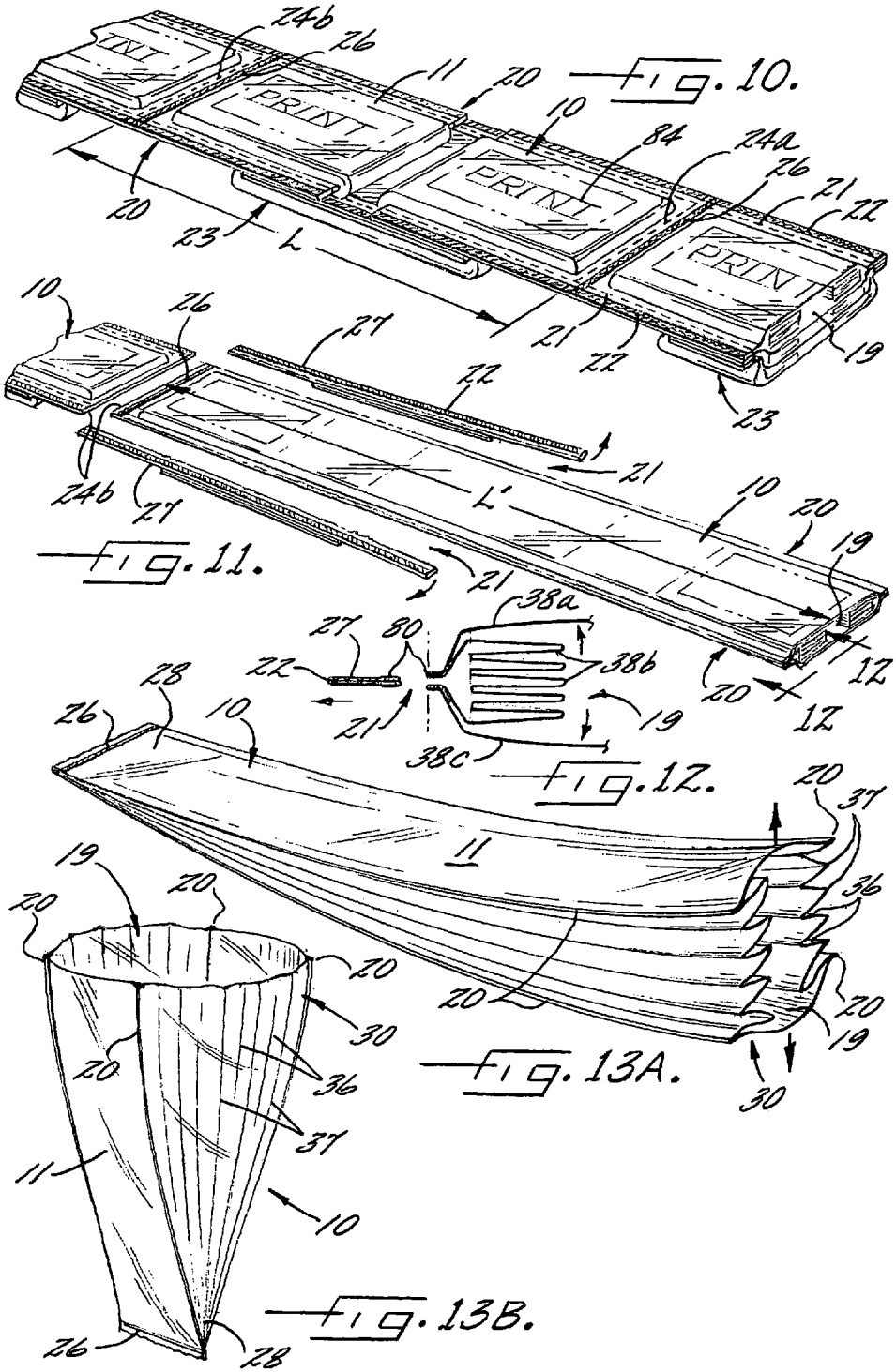
Figure 14:
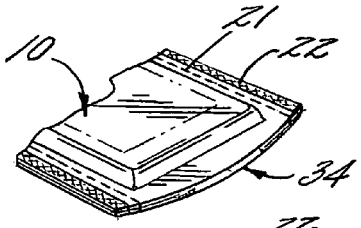
Figure 15A:
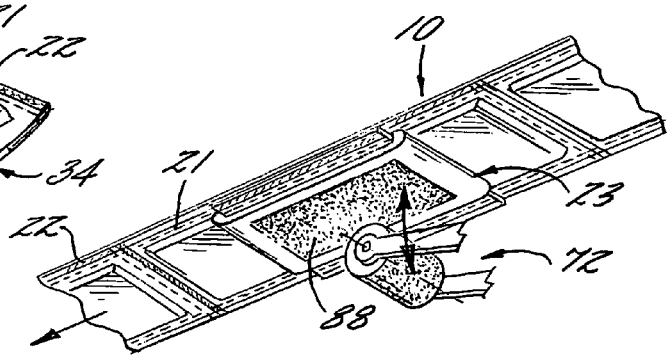
Figure 15B:
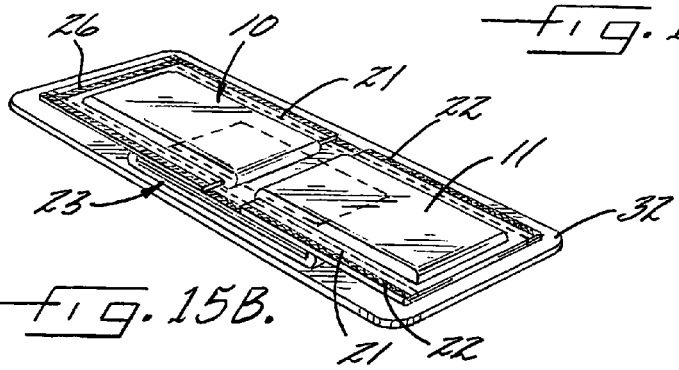
Figure 16A:
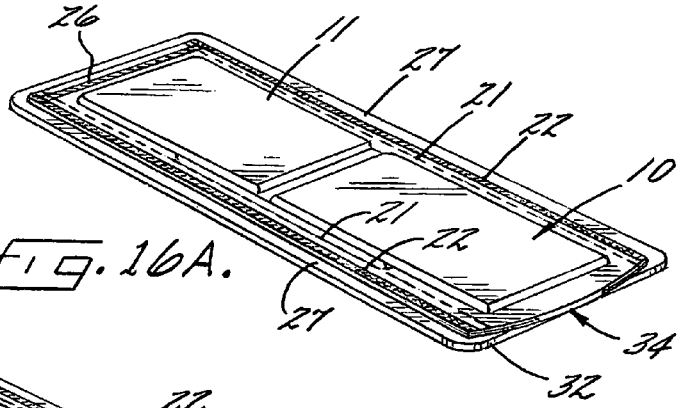
Figure 16B:
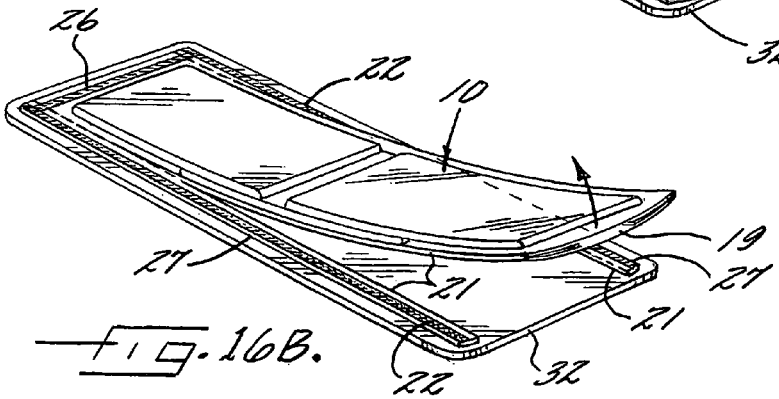
Figure 17B:
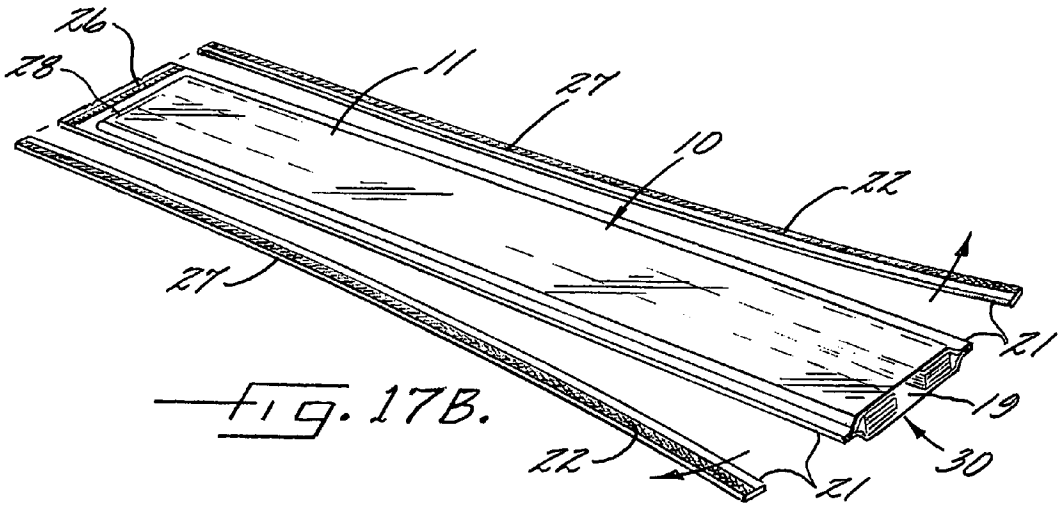
Figure 17A:
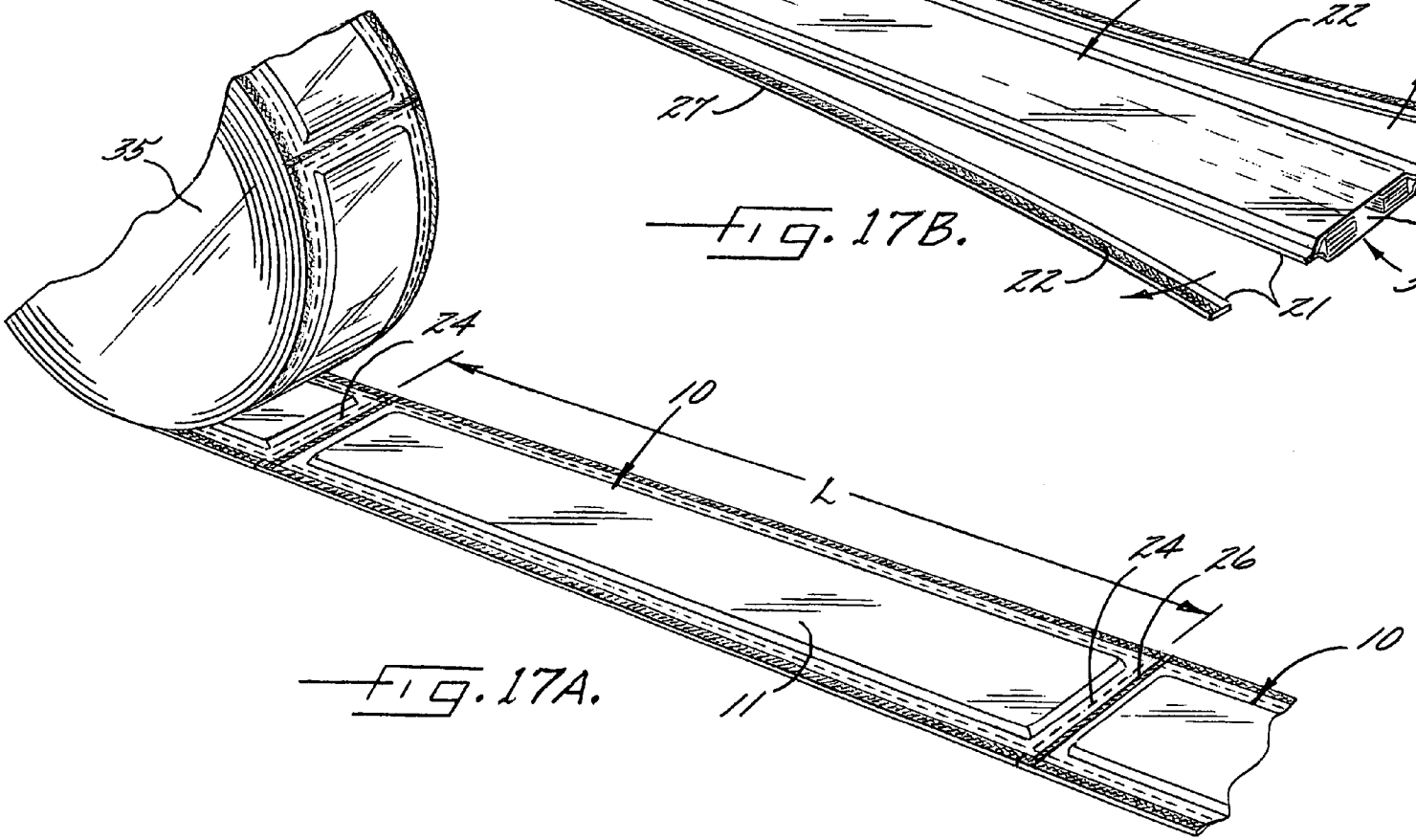
Figure 18A:
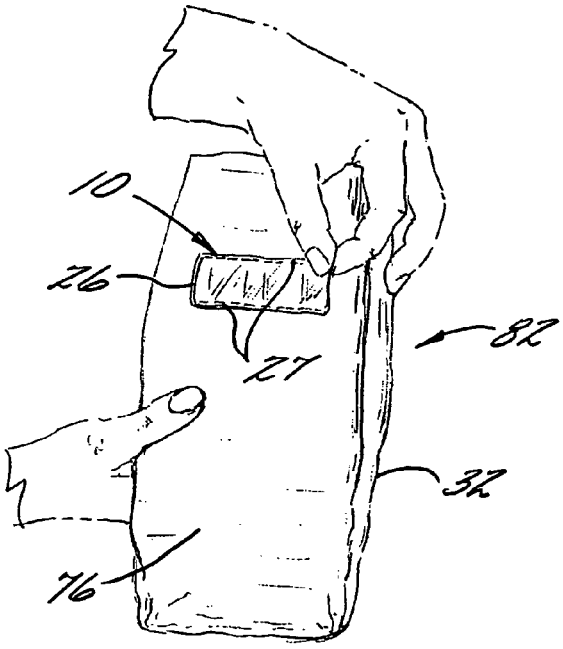
Figure 18B:
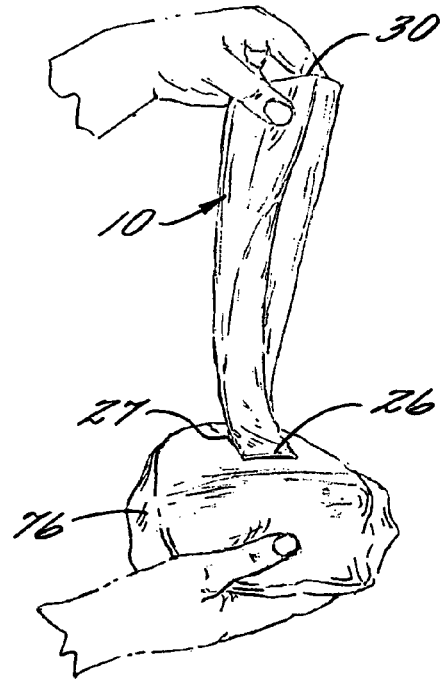
Figure 18C:
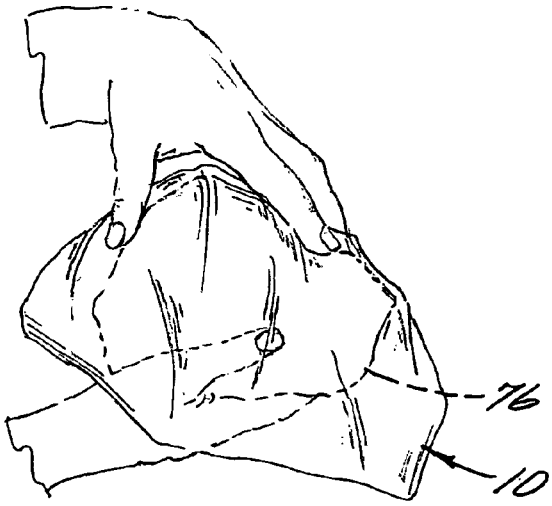
Figure 18D:
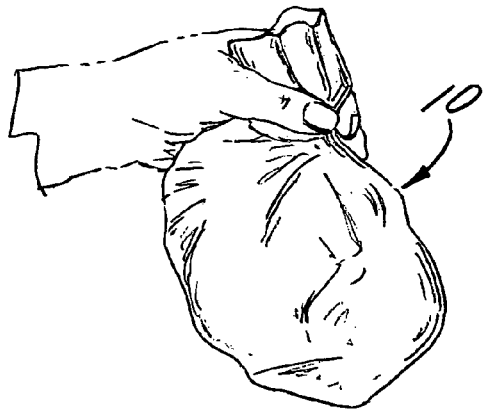
Figure 19A:
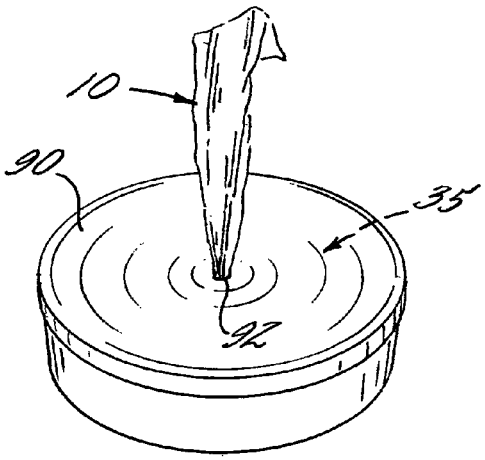
Figure 19B:
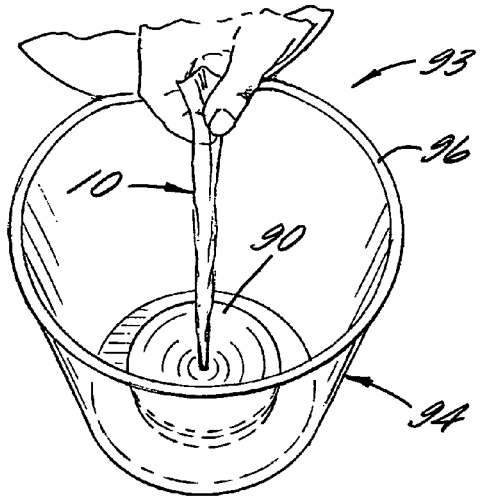
Figure 19C:
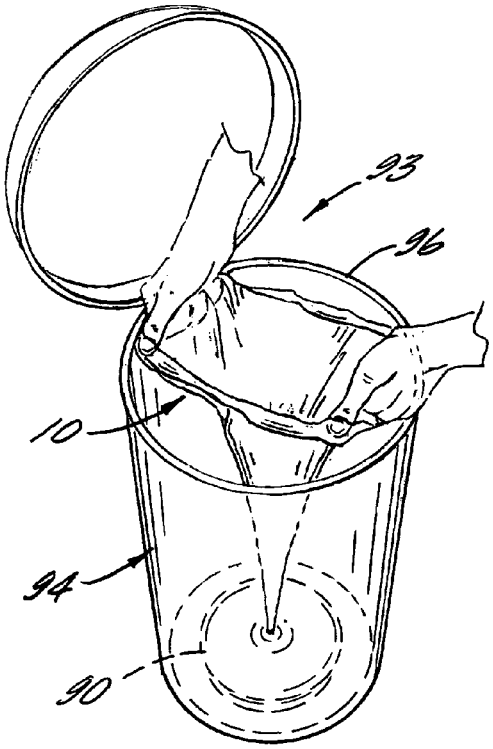
Figure 19D:
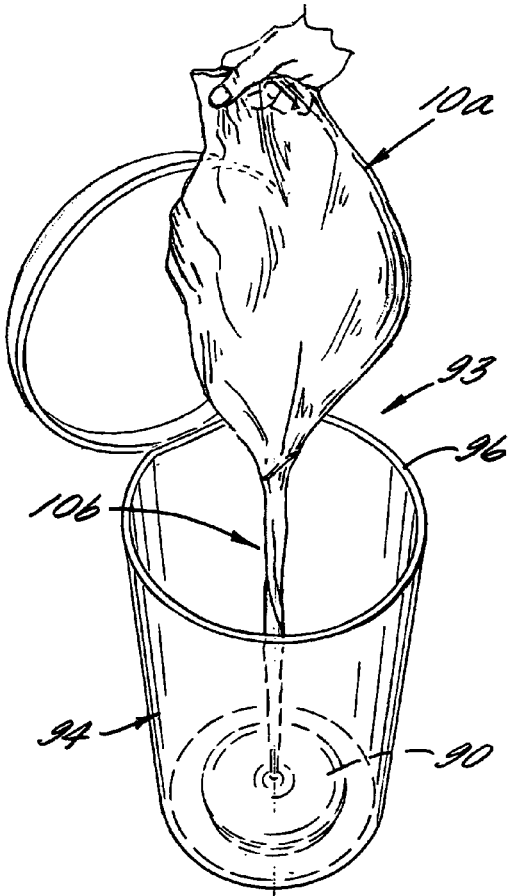

FIG. 8 is a cross-section illustration of the second sealing station 64 of FIG. 1 and also illustrates a view of tube 14 taken along line 8-8 of FIG. 7;

FIG. 9 is a cross-section illustration of the first perforation station 66 of FIG. 1;

FIG. 10 is a perspective view of a chain of bags having S-folds according to an embodiment of the present invention and a bag length of L;

FIG. 11 is a perspective view of the chain of bags of FIG. 10 wherein the bag is extended to length L';

FIG. 12 is a partial cross-section illustration taken along line 12-12 of FIG. 11 illustrating the detachment of the release portion 27 along the separation line 21;

FIG. 13*a* is a bag according to an embodiment of the present invention partially opened and detached from the adjacent bags;

FIG. 13*b* is the bag of FIG. 13*a* substantially opened;

FIG. 14 is a partial perspective view of a bag having a pull tab 34 according to an embodiment of the present invention;

FIG. 15*a* is a perspective view of an adhesive being applied at an adhesive station 72 to a bottom surface of a bag;

FIG. 15*b* is a perspective view of a bag assembly according to an embodiment of the present invention, wherein the bag of FIG. 15*a* is attached to an article 32 by the adhesive;

FIG. 16*a* is a perspective view of a bag assembly according to another embodiment of the present invention, wherein the bag is attached to an article 32 by an adhesive applied to the release portions 27;

FIG. 16*b* is the bag assembly of FIG. 16*a* illustrating the bag partially removed from the article along the separation line 21;

FIG. 17*a* is a perspective view of an embodiment of the present invention including a roll of bags, wherein the bags do not include S-folds;

FIG. 17*b* is a perspective view of a bag, according to the embodiment of FIG. 17*a*, illustrating the release portions 27 detached from the rest of the bag;

FIG. 18*a* is a perspective view of a disposable diaper system 82 embodiment of the present invention, wherein the bag 10, in a compacted configuration, is attached to a disposable diaper 76;

FIG. 18*b* is the disposable diaper system of FIG. 18*a* illustrating the bag being stretched out, while an end 26 of the bag is still attached to the diaper;

FIG. 18*c* is the disposable diaper system of FIG. 18*a* illustrating the used diaper being enclosed within the bag;

FIG. 18*d* is the disposable diaper system of FIG. 18*a* illustrating the bag holding the diaper;

FIG. 19*a* is a perspective view of an embodiment of the present invention wherein a roll of compacted bags is substantially contained within a dispensing container;

FIG. 19*b* is a perspective view of a waste disposal system 93 having the roll of compacted bags and dispensing container combination of FIG. 19*a* within a receptacle and showing a bag drawn out of the dispensing container;

FIG. 19*c* is a perspective view of the waste disposal system 93 of FIG. 19*b* illustrating the bag being opened to engage the rim of the receptacle while still attached to the roll of bags; and FIG. 19*d* is a perspective view of the waste disposal system 93 of FIG. 19*b* illustrating the lead and used bag lifted out of the garbage receptacle.

DETAILED DESCRIPTION OF THE INVENTION

The present invention now will be described more fully hereinafter with reference to the accompanying drawings, in which some but not all embodiments of the invention are shown. Indeed, this invention may be embodied in many different forms and should not be construed as limited to the embodiments set forth herein; rather, these embodiments are provided so that this disclosure will satisfy applicable legal requirements. Like numbers refer to like elements throughout.

FIG. 1 illustrates an embodiment of the invention in which a continuous tube 14 is provided from a supply roll 13 upstream in the process from unwind station 40. Tube 14 may be provided as a seamless tube (i.e., may lack longitudinal seams), or may be provided as a seamed tube, which may be formed, for example, by sealing a flat sheet to itself or by sealing two sheets together along two longitudinal seams. The tube 14 may comprise a plastic material, for example, one or more polymers, such as thermoplastic polymers, selected from polypropylene and polyethylene (e.g., low density polyethylene, high density polyethylene, and ethylene copolymers). The plastic material may comprise slip agents or other agents to improve the machinability of the tube. The tube 14 may be advanced along a predetermined path by one or more rollers 42, 44.

The tube 14 is opened at an opening station 46 such that the tube 14 may have a substantially circular circumference. The tube passes to creasing station 60, which may include one or more of the mandrel 48, the projections 58, and nipping rollers 42, 44 to sinusoidally crease the tube 14 and arrange it in a generally flat star-shaped cross-sectional configuration.

The opened tube 14 is passed over and around a leading end or edge 50 of a mandrel 48. The mandrel 48 may be shaped generally as a cone extending from the leading end 50 to a vertex or tail end 52. The leading end 50 defines an outer circumference that is configured to receive and engage the entire inner circumference of the tube 14. For example, the diameter of the leading end 50 may approach or approximate the diameter of the tube 14. A tight fit between the tube and the mandrel leading end reduces the chance of inadvertent or unwanted folds or winkles occurring in the tube 14. As illustrated, the leading end 50 may be tapered to facilitate the engagement of the tube 14 around the mandrel 48.

The mandrel 48 may comprise a plurality of grooves 54 extending from the leading end 50 to the tail end 52. Each groove 54 extends from an outwardly facing surface of the mandrel 48 inwardly to a predetermined depth. The depth of each groove 54 may increase from the leading end 50 to the tail end 52 such that the cross-sectional perimeter of the mandrel 48 remains substantially the same from the leading end 50 to the tail end 52 as the diameter of the outwardly facing surface decreases.

The mandrel 48 may be supported and suspended, for example, by a magnetic and/or mechanical support. For simplicity of illustration, FIG. 1 shows only one magnetic support 49 proximate to the leading end 50; however, a plurality of magnetic and/or mechanical supports may be employed to support the mandrel 48.

Turning to FIG. 2, the tube 14 may be passed over the leading edge 50 of the mandrel 48 and advanced toward the tail end 52. A series of projections 58 such as brushes or similar devices may force or encourage the tube 14 into the grooves 54 as the tube 14 advances so that, for example, the circumference of the tube 14 conforms to the cross-sectional perimeter of the mandrel 48. Thus, the tube 14 may be sinusoidally creased or folded about its circumference to form a generally star-shaped cross-section. Maintaining a generally constant cross-sectional perimeter of the mandrel 48, by varying the depth of the grooves 54 along the length of the mandrel 48, may help to reduce the likelihood that the tube may buckle or stretch as it is creased.

Each of the points 16 in the star-shaped configured tube (FIGS. 4-5) corresponds with one of the grooves 54. One may increase the number of points 16 of tube 14 by increasing the number of grooves 54 in the mandrel 48. The difference between the circumference of the tube 14 and the width (outer point to outer point) W of the tube 14 in the flat star-shaped configuration increases with the number of points 16. The width W (FIG. 4) of the tube in the flat star-shaped configuration may be at least about, and/or at most about, any of the following percentages of the circumference of the tube: 20, 18, 15, 13, 12, 10, 8, 7, 6, 5, 4.5, 4, 3.5, 3, 2.5, 2, 1.5, 1, and 0.5%. The tube in a star-shaped configuration may comprise at least about, and/or at most about, any of the following number of points: 5, 6, 8, 10, 12, 14, 16, 18, 20, 22, 24, 26, 28, 30, 35, and 40. However, the foregoing lists of percentages and numbers are for illustrative purposes only. The width W of the tube in the flat star-shaped configuration may be of any percentage of the circumference of the tube. And the number of points 16 may be any number equal to or greater than five.

Figure 3:
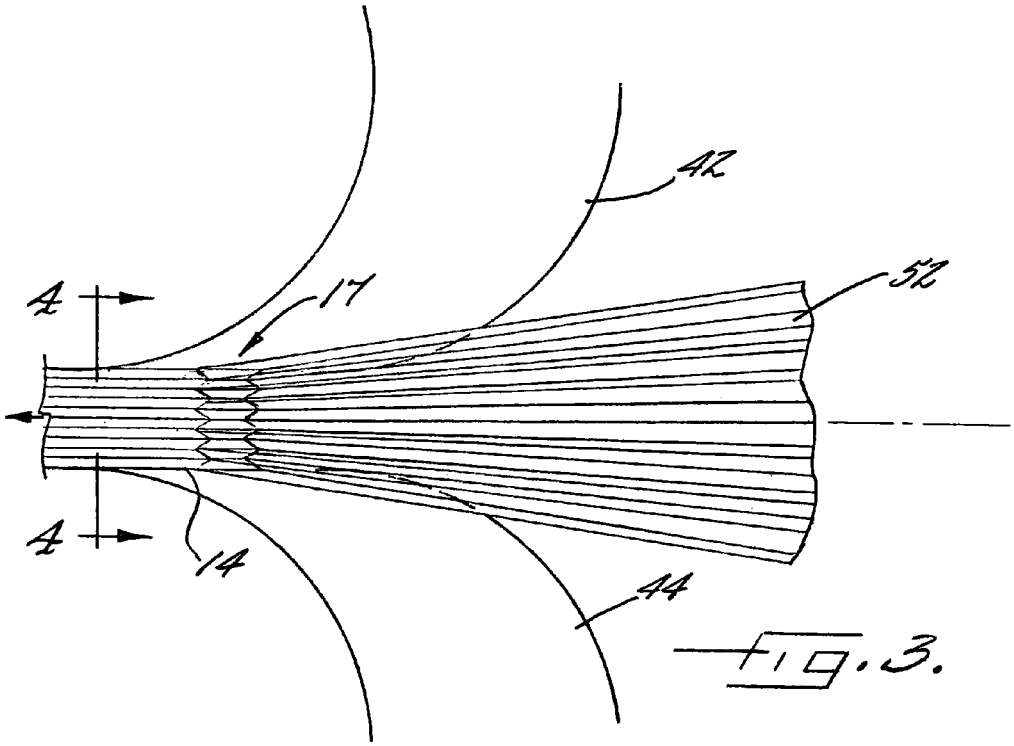
FIG. 3 is a side illustration of the nipping rollers proximate the mandrel for arranging a star-shaped configured tube into a generally flat star-shaped configuration.
Figure 4:
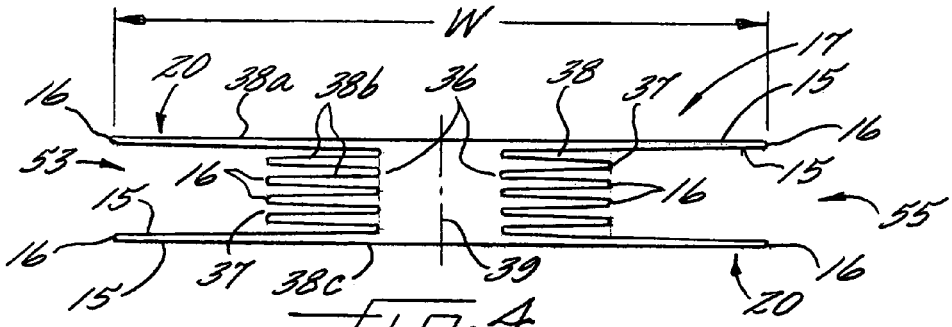
FIG. 4 is a cross-section illustration of the generally flat star-shaped configuration of a tube according to an embodiment of the present invention and taken along line 4-4 of FIG. 3.

Downstream from the mandrel 48, the tube 14 in the cross-sectional star-shaped configuration may be arranged into a generally flat star-shaped structure or configuration 17 as illustrated in FIG. 4. One method of arranging the tube 14 in this manner is by using a pair of nipping rollers 42, 44 as illustrated in FIGS. 1-3. The rollers 42, 44 compress the tube 14 to form the generally flat star-shaped configuration 17.

The generally flat star-shaped configuration 17 may be separated by a longitudinal axis 39 to separate the structure into left and rights sides 53, 55, respectively, on opposing sides of the longitudinal axis. The left and right sides 53, 55 of the structure may each comprise a plurality of points 16. The left and right sides may comprise an equal number of points 16 (as illustrated in FIG. 4), or the generally flat star-shaped configuration may have different numbers of points 16 on the opposing left and right sides. The number of points 16 on the left side 53 may be within the number of points on the right side 55 by plus or minus any of the following numbers of points: 10, 8, 6, 5, 4, 3, 2, and 1. The number of points 16 on the left side 53 may equal the number of points 16 on the right side 55 of the longitudinal axis. The longitudinal axis 39 may divide the generally flat star-shaped configuration 17 into substantially equal halves as illustrated in FIG. 4. The inner folds 36 on the left and right sides 53, 55 may each extend proximate to or beyond the longitudinal axis 39, such that some of the inner folds 36 on the left and right side 53, 55 may extend into the opposing side. Note that the space between adjacent points 16 may be exaggerated in the figures for illustration purposes.

One aspect of the present invention is the continuous formation of the generally flat star-shaped cross-sectional configuration along the length of the tube 14 to provide a compacted folded structure. The folded tube 14 includes a plurality of alternating inner and outer longitudinally extending folds 36, 37, respectively. The folds 36, 37 in combination define a plurality of outwardly extending projections 38. These projections 38 are stacked on the left side 53 and the right side 55 of the structure on opposite sides of the longitudinal axis. (FIG. 4.) The outer folds 37 define the outer points 16. The inner folds 36 delineate adjacent projections 38. A projection 38 may be considered to be on a particular side of the axis if the majority of the projection is on that side. As described above, one or more of the inner folds may extend into the opposing side. Therefore a portion of a projection may be in the opposing side.

On each side of the generally flat star-shaped configured tube 17, any of one or a plurality of intermediate projections or points 38*b* may be between first or top projection or point 38*a* and the last or bottom projection or point 38*c*. Also on each side of the structure, the top projection 38*a* and the bottom projection 38*c* may extend beyond the intermediate projections 38*b*. This may be accomplished by configuring the grooves 54 such that selective grooves on the mandrel 48 extend deeper inwardly relative to the rest of the grooves 54. (FIG. 2.) The portions of the projections 38*a*, 38*c* that extend beyond the intermediate projections 38*b* may be used to form edge tabs 20.

Figure 5:
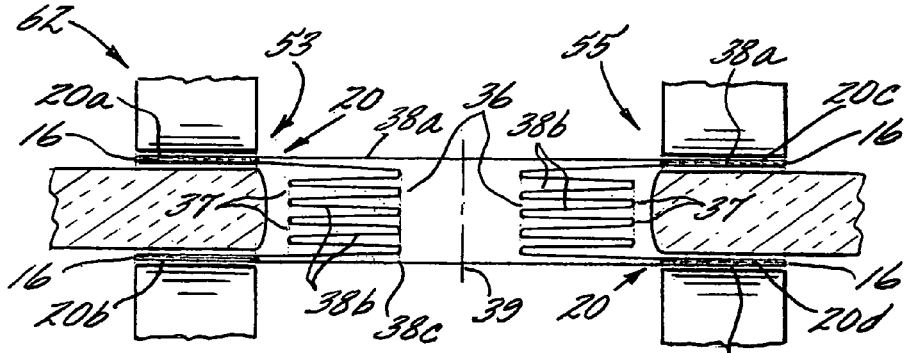
FIG. 5 is a cross-section illustration of the first sealing station 62 of FIG. 1 taken along line 5-5 of FIG. 1.

As shown in FIG. 5, the two converging film layers of each edge tab 20 may be sealed together at a first sealing station 62. For example, selected portions of the two film layers 15 that form the top projection 38*a* on the left side may be heat sealed together to form a left top edge tab 20*a* and on the right side to form right top edge tab 20*c*. Selected portions of the two film layers 15 that form the bottom projection 38*c* on the left side may be heat sealed together to form bottom edge tab 20*b* and on the right side to form right bottom edge tab 20*d*. The sealed portion forming each edge tab 20 may extend inwardly from the edge of the top or bottom projections 38*a* or 38*c* to an area proximate to the edge of the intermediate projections 38*b*.

Figure 6:
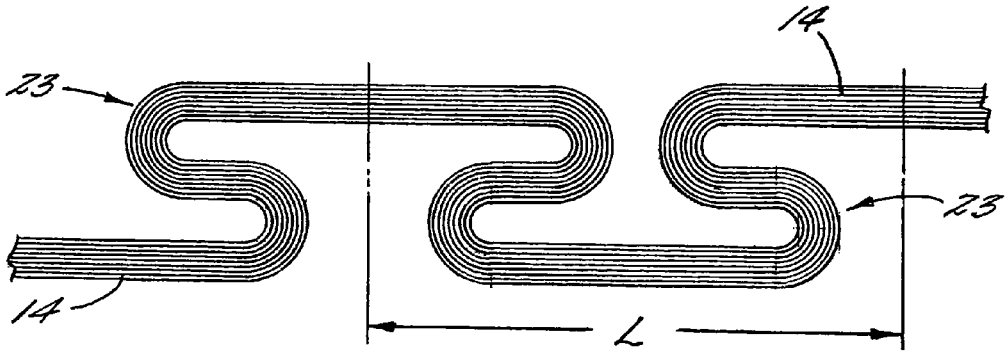
FIG. 6 is a side illustration of the S-folds in tube 14.

Turning to FIGS. 6 and 7, the tube 14 may be compacted lengthwise or in the longitudinal direction by folding the plastic material 14 along its width with a pair of approximately 180 degree turns to form S-folds 23. Each S-fold 23 may be formed by a series of retractable rollers (not illustrated).

To encourage the retention of the generally flat star-shaped configuration 17 and/or the one or more S-folds 23, the left top and bottom edge tabs 20*a,b* may be sealed together, and the right top and bottom edge tabs 20*c,d* may be sealed together, for example, at a second sealing station 64.

As shown in FIG. 8, the left two edge tabs 20*a,b* may be sealed (e.g., heat sealed) together to form left edge margin 22*a*, which may include the overlapping areas caused by any S-folds 23. Similarly, the right two edge tabs 20*c,d* may be sealed together to form right edge margin 22*b*, which may include the overlapping areas caused by any S-folds 23. As further explained below, the seal forming edge margins 22 may not extend as far inward as does the top and bottom edge tab seals 20 described above. Each edge margin 22 may be formed such that each edge tab 20 contains an inward area 80 that is not sealed to another edge tab 20. As illustrated in FIGS. 8-9, the left edge margin 22*a* encloses the intermediate projections 38*b* on the left side and the right edge margin 22*b* encloses the intermediate projections 38*b* on the right side.

Longitudinal separation lines 21 may be formed along the length of the tube 14 within the inward area 80, that is, within the edge tabs 20, but outside the edge margins 22*a,b*. A left longitudinal separation line 21 may be formed proximate and parallel to the sealed edge margin 22*a* of the left side of the tube 14, and a right longitudinal separation line 21 may be formed proximate and parallel to the sealed edge margin 22*b* of the right side of the flat star-shaped configured tube 14. Each longitudinal separation line 21 may be position in and/or through corresponding edge tabs 20, but not in or through the edge margins 22 as shown in FIG. 9. This arrangement allows for a release portion 27 (FIGS. 11, 12, 17*b*) comprising edge margin 22 and a portion of the edge tabs 20 to be detached or torn away from the remainder of the tube 14 without creating an opening or perforations into the interior 19 of the tube.

The separation lines 21 may comprise a series of perforations, or other types of weakening such as scoring or thinning, in order to facilitate the detachment of release portion 27. For example, a perforation line may be created at first perforating station 66 (FIG. 9).

The tube 14 or a folded bag 10 may be attached to an article 32 by attaching release portions 27 to the article 32. Article 32 may comprise, for example, a cardboard backing as shown in FIGS. 16*a* and 16*b*, or comprise any of a disposable diaper or feminine hygiene product, as discussed below. The release portions 27 may be removed from bag 10 by tearing along the perforated lines 21.

Tube 14 may be segmented into individual or discrete bags 10 by forming transverse separation lines 24*a,b* across the width of the tube 14 at a desired or predetermined intervals of the tube 14, as shown in FIG. 10. The transverse separation lines may be any of the types of lines that may facilitate separation as described in conjunction with the longitudinal separation lines above. In addition to the transverse separation lines 24, a sealed end 26 may extend transversely across the tube generally parallel to and proximate each transverse separation line 24. Sealed end 26 may be formed by a transverse heat seal. The transverse separation lines 24 and the sealed end 26 may be formed at a second perforation station 68 and third sealing station 70 respectively, as illustrated in FIG. 1.

FIG. 10 illustrates individual bags 10 formed from the continuous tube 14. The dimension L illustrates the length from a sealed end 26 forming the bottom of the bag to a separation line 24 forming the top of the bag. The sealed end 26 between two consecutive transverse separation lines 24*a,b*, and proximate the trailing separation line 24*b*, forms the bottom closure 28 of the bag 10 as seen in FIGS. 13*a* and 13*b*. The leading separation line 24*a* forms the top opening or top end 30 of the bag 10. The tube 14 forms the wall 11 of the bag 10. Wall 11 is folded alternately inwardly and outwardly along a plurality of longitudinally extending fold lines 36, 37 that are spaced about the circumference of the wall 11. Wall 11 may be placed in a generally flat star-shaped configuration as shown in FIGS. 10 and 11.

Each bag 10 may include a pair of transverse S-folds 23 (FIG. 10) or a bag may not have any S-folds 23. Each bag may include at least, and/or at most, any of the following number of transverse S-folds: 2, 4, 6, 8, 10, 12, 14, and 20.

A bag 10 may be removed from the string or chain of bags by detaching release portions 27 and tearing separation lines 24. (FIGS. 11-12.) The bag 10 may be expanded lengthwise to L' (FIG. 11) by unfolding the S-folds 23. The bag 10 may be expanded circumferentially by unfolding inner and outer folds 36, 37 as shown in FIGS. 13*a* and 13*b*. The top end 30 may be opened substantially to the circular circumference of the tube 14.

A string or chain of a plurality of attached bags 10 formed from tube 14 may be rolled up into a roll 35 as shown in FIG. 1. FIG. 17*a* illustrates an embodiment of roll 35 comprising a plurality of bags 10 without S-folds 23.

FIGS. 19*a* through 19*d* illustrate a waste disposal system 93 embodiment of the present invention. A roll 35 of a plurality of attached bags 10 may be contained substantially within a dispensing container 90. The dispensing container 90 may be shaped to correspond to the roll 35, in order to minimize the overall size of the dispensing container 90, and/or may be shaped to correspond to a receptacle 94 in which the container may be placed. For example, the dispensing container 90 may be configured to fit into and rest on the bottom of a larger container, such as a garbage receptacle 94. The dispensing container 90 defines an interior (not shown) to support roll 35. The dispensing container 90 further defines an opening 92 through which one or more bags of the chain of attached bags 10 may extend.

As shown in FIG. 19*c*, a user may draw or extend a first bag 10 from the dispensing container 90 and open the bag 10 to engage the rim portion 96. The first bag 10*a* may remain attached to a second and subsequent bag 10*b* on the roll, as shown in FIG. 19*d* so that as the user lifts the first bag out of the garbage receptacle 94 to discard the filled first bag 10*a*, the second and subsequent bag 10*b*, still attached to the first bag 10*a*, is lifted and positioned approximately to the rim portion 96 ready for use. Alternatively, the first bag may be detached from the chain before the first bag is engaged with the receptacle rim and/or filled (not illustrated).

A bag 10 may be attached to an article 32, such as a cardboard backing, as shown in FIGS. 16*a* and 16*b*. For example, an adhesive may be applied to the edge margins 22 or to the release portions 27 to attach a pre-released folded bag to an article 32. The release portions 27 may be detached from bag 10, and may remain attached to the article 32, by tearing along the longitudinal separation lines 21.

Alternatively and as shown in FIGS. 15*a* and 15*b*, adhesive 88 may be applied, for example at an adhesive station 72, to a larger portion of a bottom side of the bag 10 for attaching the bag 10 to an article 32. For example, the bag 10 may remain attached to the article 32 during the use of the bag 10.

The bag 10 in an unfolded state may be large enough to substantially enclose an article 32 to which the bag is attached. For example, the bag may be configured to substantially surround or hold the article so that an end user may unfold the bag from its compacted or folded configuration to an unfolded form after either fully detaching the bag from the article or while the bag is at least partially attached to the article.

For example, FIGS. 18*a* through 18*d* illustrate an embodiment of the present invention in which article 32 is a disposable diaper 76. Disposable diaper system 82 comprises disposable diaper 76 and compacted bag 10 attached to the diaper. The release portions 27 of the bag 10 may be attached to the diaper 76. For example, the release portions 27 may be adhered to the diaper 76. As shown in FIG. 18*b*, the sealed end 26 of the bag 10 may also be attached to the diaper 76 such that when the bag 10 is pulled from the diaper 76 by detaching release portions 27, the heat sealed end 26 remains attached to the diaper 76. FIGS. 18*c* and 18*d* illustrate the bag 10 being opened around the diaper 76 such that the diaper 76 is contained within the interior of the bag 10.

As shown in FIGS. 14, 16*a*, and 16*b*, bag 10 may comprise a pull tab portion 34 protruding from the bag to facilitate detachment of the bag. Pull tab portion 34 may be formed, for example, by at least partially curving or arching the transverse separation line 34. The pull tab 34 may be configured to overhang the article 32 to facilitate the removal and/or opening of the bag 10. Printing indicia 84 may be printed on an outer surface of the bag 10, as shown in FIG. 10.

Many modifications and other embodiments of the invention set forth herein will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A folded and flattened bag comprising:

a tube wall having a circumference extending about a longitudinal axis of the tube wall, a first region of the wall on a first side of the longitudinal axis being folded alternately inwardly and outwardly along a plurality of longitudinally extending inward and outward fold lines that are circumferentially spaced apart, a second region of the wall on an opposite second side of the longitudinal axis being folded alternately inwardly and outwardly along a plurality of longitudinally extending inward and outward fold lines that are circumferentially spaced apart, the wall then being flattened such that the first and second regions of the wall respectively define opposite first and second edges of the folded and flattened bag and such that each of the first and second edges has a plurality of outer points defined by the outward fold lines and stacked one upon another;

wherein at each of the first side and the second side there is a top outer point and a bottom outer point and a plurality of intermediate outer points between the top and bottom outer points; and wherein the top and bottom outer points at each of the first and second sides are spaced outwardly of the intermediate outer points therebetween such that there are areas of the tube wall extending beyond the intermediate outer points and forming top and bottom edge tabs, each top and bottom edge tab being formed by two adjacent portions of the tube wall connected at the respective outward fold line, and wherein a portion of the top and bottom edge tabs are sealed together at each of the first and second edges of the folded and flattened bag to form respective opposite edge margins to enclose the intermediate outer points; wherein each side of the bag defines a longitudinal separation line extending through the top and bottom edge tabs and located between the edge margin and the intermediate outer points, wherein the longitudinal separation line defines a corresponding detachable release portion.

2. The folded and flattened bag according to claim 1 wherein the tube wall comprises thermoplastic polymer.

3. The folded and flattened bag according to claim 1 wherein the wall is arranged into a generally flat star-shaped configuration having at least 10 outer points, with at least five of the outer points stacked on the first side of the bag and at least five of the outer points stacked on the second side of the bag.

4. The folded and flattened bag according to claim 1 wherein the wall is arranged into a generally flat star-shaped configuration having at least 16 outer points, with at least 8 of the outer points stacked on the first side of the bag and at least 8 of the outer points stacked on the second side of the bag.

5. The folded and flattened bag according to claim 1 wherein a width of the folded bag in the flat star-shaped configuration is at most about 20% of the circumference of the tube wall.

6. The folded and flattened bag according to claim 1 wherein a width of the folded bag in the flat star-shaped configuration is at most about 13% of the circumference of the tube wall.

7. The folded and flattened bag according to claim 1, wherein the wall defines a width and a length and has at least one S-fold extending across the width for shortening the length of the bag.

8. The folded and flattened bag according to claim 7 comprising at least three S-folds each extending across the width.

9. The folded and flattened bag according to claim 1, wherein the tube wall is sealed together transversely to form a sealed end at a bottom of the folded bag.

10. The folded and flattened bag according to claim 1, wherein the two adjacent portions of the top edge tab are sealed together and the two adjacent portions of the bottom edge tab are sealed together.

11. A method of opening a folded bag comprising:

providing the folded bag of claim 1;

detaching the detachable release portions; and expanding the folded tube wall to open the bag.

12. The folded and flattened bag according to claim 1, further comprising an adhesive applied to the tube wall for attaching the folded bag to an article.

13. The folded and flattened bag according to claim 12, wherein the adhesive is applied to the release portions.

14. The folded and flattened bag according to claim 1 in combination with an article wherein the tube wall is attached to the article.

15. The folded and flattened bag according to claim 1 in combination with an article wherein:

the tube wall is attached to the article; and the folded bag in an unfolded state is large enough to substantially enclose the article.

16. The combination according to claim 15, wherein the article is a disposable diaper.

* * * * *